US010434800B1

(12) United States Patent
Colonel et al.

(10) Patent No.: US 10,434,800 B1
(45) Date of Patent: Oct. 8, 2019

(54) PRINTER ROLL FEED MECHANISM

(71) Applicant: Datamax-O'Neil Corporation, Orlando, FL (US)

(72) Inventors: Kenneth Colonel, Oviedo, FL (US); Richard Hatle, Casselberry, FL (US); Michael James Wells, Lake Stevens, WA (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/982,607

(22) Filed: May 17, 2018

(51) Int. Cl.

| | |
|---|---|
| ***B41J 11/00*** | (2006.01) |
| ***B41J 15/04*** | (2006.01) |
| ***B65H 23/24*** | (2006.01) |
| ***B65H 16/10*** | (2006.01) |
| ***B65H 20/12*** | (2006.01) |
| ***B41J 2/325*** | (2006.01) |

(52) U.S. Cl.
CPC ..... *B41J 11/0095* (2013.01); *B41J 2/325* (2013.01); *B41J 11/0085* (2013.01); *B41J 15/046* (2013.01); *B65H 16/106* (2013.01); *B65H 20/12* (2013.01); *B65H 23/245* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,141,516 | A * | 2/1979 | Olson | A47K 10/36 226/129 |
| 5,884,861 | A * | 3/1999 | Hosomi | B26D 1/305 242/563 |
| 6,135,384 | A * | 10/2000 | Skelly | B41J 29/48 116/67 A |
| 6,234,696 | B1 | 5/2001 | Whittaker | |
| 6,502,784 | B1 * | 1/2003 | Sato | B65H 26/08 242/348 |
| 6,517,025 | B1 * | 2/2003 | Budz | A47K 10/3818 242/563 |
| 6,667,753 | B2 | 12/2003 | Kaya | |
| 6,832,725 | B2 | 12/2004 | Gardiner et al. | |
| 7,128,266 | B2 | 10/2006 | Zhu et al. | |
| 7,159,783 | B2 | 1/2007 | Walczyk et al. | |
| 7,413,127 | B2 | 8/2008 | Ehrhart et al. | |
| 7,648,098 | B2 * | 1/2010 | Goeking | A47K 10/3818 242/563 |
| 7,726,575 | B2 | 6/2010 | Wang et al. | |
| 8,294,969 | B2 | 10/2012 | Plesko | |
| 8,317,105 | B2 | 11/2012 | Kotlarsky et al. | |

(Continued)

FOREIGN PATENT DOCUMENTS

| | | | |
|---|---|---|---|
| WO | 1997022477 | A1 | 6/1997 |
| WO | 2013163789 | A1 | 11/2013 |

*Primary Examiner* — Kristal Feggins
(74) *Attorney, Agent, or Firm* — Additon, Higgins & Pendleton, P.A.

(57) ABSTRACT

A media feeding system comprises a driver configured to rotate a media roll in a first direction; a vacuum roller positioned in a media feed path and configured to rotate in the first direction; and a media end detecting sensor positioned in the media feed path, the media end detecting sensor being configured to detect a leading edge of the media; wherein the driver rotates the media roll in a second direction opposite the first direction in response to the sensor detecting the leading end of the media.

20 Claims, 5 Drawing Sheets

(56) References Cited

U.S. PATENT DOCUMENTS 8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,494,412 B2 * 7/2013 Moore ..... G03G 15/6517 399/121
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.

(56) References Cited

U.S. PATENT DOCUMENTS

| | | | |
|---|---|---|---|
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | Akel et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,073,718 | B2 | 7/2015 | Chen |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Wang |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |

(56) References Cited

U.S. PATENT DOCUMENTS 9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2002/0109037 A1* 8/2002 Mizuno ..... B41J 11/0075 242/563
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2012/0251148 A1* 10/2012 Moore ..... G03G 15/6517 399/66
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0053810 A1* 2/2015 Chang ..... B65H 26/08 242/563
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.

(56) References Cited

U.S. PATENT DOCUMENTS

2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0136976 A1* 5/2016 Shinjo ..... B41J 15/16 347/104
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschinie et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Jonas et al.
2017/0193727 A1 7/2017 Van Horn et al.

(56) References Cited

U.S. PATENT DOCUMENTS

| | | | |
|---|---|---|---|
| 2017/0200108 | A1 | 7/2017 | Au et al. |
| 2017/0200275 | A1 | 7/2017 | McCloskey et al. |

* cited by examiner

PRINTER ROLL FEED MECHANISM

FIELD OF THE INVENTION

The invention is generally related to a printer roll feed mechanism, and, more specifically, to a printer roll feed mechanism with a vacuum roller.

BACKGROUND

When loading roll media into a printer, conventional printers generally require a user to first place the media roll into the printer, and then manually feed a leading end of the media into a roll feed mechanism. This process is often frustrating to a user, because space within the printer is limited, making the manual task of feeding the media tedious. When a user is in a demanding and stressful position, such as a cashier in a busy checkout line, loading a roll of receipt media in a printer can increase the stress of the cashier if the receipt media is difficult to manually feed into the printer roll feed mechanism.

A printer that used an auto-feed mechanism that reduces or eliminates the need to manually feed the media into the roll feed mechanism would be beneficial to users.

SUMMARY

Accordingly, in one aspect, the present invention embraces a method for loading print media in a printer that includes rotating a print media roll in a first direction, rotating in the first direction a vacuum roller positioned in a media path, detecting a leading edge of the print media with a media end detecting sensor positioned in the media path, rotating the print media roll in a second direction in response to detecting the leading edge of the print media, and guiding the print media along the media path with the vacuum roller.

In an exemplary embodiment, the method includes rotating the print media roll with a driving roller configured to rotate in a first direction and a second direction.

In another exemplary embodiment, the first direction is opposite of the second direction.

In yet another exemplary embodiment, the first direction is clockwise.

In yet another exemplary embodiment, the second direction is counterclockwise.

In yet another exemplary embodiment, the vacuum roller is perforated and operatively connected to a vacuum source.

In yet another exemplary embodiment, the media end detecting sensor is positioned proximate to the vacuum roller.

In yet another exemplary embodiment, the print media is guided along a media path by a media guide positioned proximate to the vacuum roller.

In yet another exemplary embodiment, the print media is guided along a media path by a media guide positioned proximate to the vacuum roller and at least a portion of the guide is perforated.

In yet another exemplary embodiment, the method includes moving the print media along the media path towards pinch rollers, detecting the leading edge of the print media with a leading end detecting sensor positioned proximate to the pinch rollers, removing vacuum from the vacuum roller in response to detecting the leading edge of the print media, and guiding the print media forward with the pinch rollers.

In another aspect, the present invention embraces a media feeding system that includes a driver configured to rotate a media roll in a first direction, a vacuum roller positioned in a media feed path and configured to rotate in the first direction, and a media end detecting sensor positioned in the media feed path, the media end detecting sensor being configured to detect a leading edge of the media, wherein the driver rotates the media roll in a second direction opposite the first direction in response to the sensor detecting the leading end of the media.

In an exemplary embodiment, the driver comprises a driving roller configured to rotate in a first direction and a second direction.

In another exemplary embodiment, the vacuum roller is perforated and operatively connected to a vacuum source.

In yet another exemplary embodiment, the media end detecting sensor is positioned proximate to the vacuum roller.

In yet another exemplary embodiment, the media feeding system includes a media guide positioned proximate to the vacuum roller along a length of a media path.

In yet another exemplary embodiment, the media feeding system includes a media guide positioned proximate to the vacuum roller along a length of a media path and at least a portion of the media guide is perforated.

In yet another exemplary embodiment, the media feeding system includes pinch rollers positioned along the media feed path and a leading end detecting sensor located proximate to the pinch rollers, the sensor configured to detect the leading edge of the media, and vacuum is removed from the vacuum roller and the media is guided forward by the pinch rollers in response to the leading end detecting sensor detecting the leading end of the media.

In yet another aspect, the present invention embraces a printer that includes a housing, a printing mechanism positioned in the housing, and a media feeding mechanism positioned in the housing, which includes a vacuum roller positioned in a media path, the vacuum roller being configured to rotate in a first direction and push media along a media path, a media end detecting sensor positioned in the media path, a driver configured to rotate a media roll in a second direction in response to the media end detecting sensor detecting a leading end of the media, and a guide configured to guide media pushed by the vacuum roller along the media path.

In an exemplary embodiment, at least a portion of the guide is perforated.

In another exemplary embodiment, the printer includes pinch rollers positioned along the media path and a leading end detecting sensor positioned proximate to the pinch rollers, the leading end detecting sensor being configured to detect the leading end of the media and vacuum is removed from the vacuum roller in response to detecting the leading edge of the media and the media is guided forward by the pinch rollers.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

The invention will now be described by way of example, with reference to the accompanying Figures, of which.

DETAILED DESCRIPTION

Figure 1:
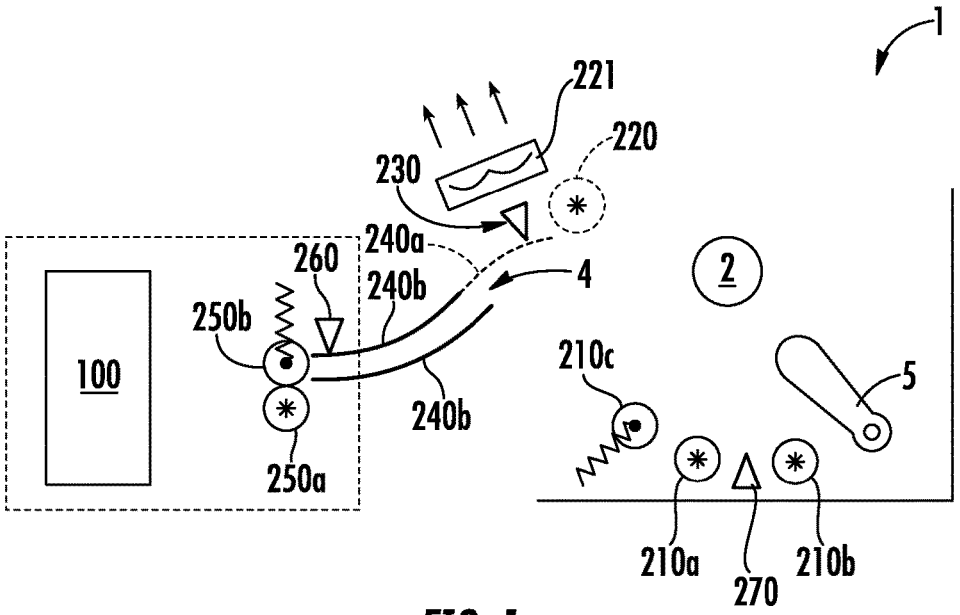
FIG. 1 is a schematic view of a printer prior to insertion of a roll of media.

In the embodiments shown in FIGS. 1-7, a printer 1 comprises a housing, a printing mechanism 100, an automatic media feeding system 200, and a media feed path 4. Various embodiments of the present invention will be described in relation to a thermal transfer barcode printer. As used herein, the term "printer" refers to a device that prints text, barcodes, illustrations, etc. onto the print media (e.g., labels, tickets, plain paper, receipt paper, plastic transparencies, and the like). In the thermal transfer printer, an ink ribbon supplies the media (e.g., ink) that transfers onto the print media. However, the present invention may be equally applicable to other types and styles of printers that may benefit from using a media guide therein (e.g., a direct transfer barcode printer).

The housing (not labeled) can be any printer housing known to those of ordinary skill in the art. As generally shown in FIGS. 1-7, the housing comprises a media hanger assembly 2 onto which a roll of media 3 can be in positioned. The terms "media", "media roll", "roll of media", etc., are understood to comprise labels, tickets, plain paper, plastic transparencies, print ribbon, and the like. In an embodiment, the housing comprises a media center biasing mechanism 5, which contacts installed media 3 to hold the media 3 centered on the media hanger assembly 2.

The printing mechanism 100 is any printing mechanism known to the skilled artisan.

The automatic media feeding system 200 comprises a media driver 210*a*, 210*b*, a vacuum roller 220, a media end detecting sensor 230, a media guide 240*a*,240*b*, pinch rollers 250*a*, 250*b*, and a leading end detecting sensor 260. In some embodiments, the printer does not include any media drivers. In some embodiments, the printer includes a powered media hanger assembly for rotating the media roll 3.

The media driver 210*a* is a driving roller that contacts a media roll 3 positioned in a printer 1 and rotates the media roll 3 in a first direction. The first direction can be either clockwise or counterclockwise. In an embodiment, the driving roller 210*a* is configured to rotate in the first direction and/or a second direction opposite the first direction, the second direction being either clockwise or counterclockwise. In the embodiment shown in FIGS. 1-7, the printer comprises a two or more driving rollers 210*a*, 210*b*. In another embodiment shown in FIGS. 1-7, a spring loaded free roller 210*c* contacts the media roll 3 and biases the media roll 3 against the driving rollers 210*a*, 210*b*.

A media roll detecting sensor 270 can be positioned in the housing proximate to the media hanger assembly 2 and detect a presence of a media roll 3 installed in the printer 1. In an embodiment, the media roll detecting sensor 270 is an infrared (IR) sensor, such as an IR-based photodiode sensor. In other embodiments, the media roll detecting sensor 270 is an imager-based sensor, or any other sensor known to the skilled artisan to detect a presence of media 3 in the printer 1.

In the embodiments shown in FIGS. 1-8, the vacuum roller 220 is generally cylindrical roller with a hollow vacuum transmitting interior. As shown more particularly in the embodiment of FIG. 8, a plurality of vacuum holes 220*a* are disposed on the surface of the vacuum roller 220, and each of the vacuum holes 220*a* is in operative communication with the vacuum transmitting interior such that a vacuum is created at each of the vacuum holes 220*a*. The vacuum roller 220 is configured to rotate in the first direction and/or the second direction. The vacuum transmitting interior of the vacuum roller 220 is operatively connected to a vacuum generator 221, such as a fan and plenum, or other vacuum generating mechanisms. The vacuum roller 220 is positioned in the media feed path 4.

The printer 1 can also comprise one or more motors (not shown) operatively connected to the driving rollers 210*a*, 210*b* and vacuum roller 220 for rotating the rollers in the first and second directions.

The media end detecting sensor 230 is positioned along the media feed path 4 proximate to the vacuum roller 220, the media end detecting sensor 230 being configured to detect a leading edge 3*a* of the media 3. In an embodiment, the media end detecting sensor 230 is an infrared (IR) sensor, such as an IR-based photodiode sensor. In other embodiments, the media end detecting sensor 230 is an imager-based sensor, or any other sensor known to the skilled artisan to detect a leading edge 3*a* of the media 3.

As shown in the embodiments of FIGS. 1-8, the media guide comprises a perforated media guide 240*a* on a first end and a pair of opposing solid media guides 240*b* on an opposite second end. For example, in FIG. 1, the pair of opposing solid media guides 240*b* is shown as two parallel solid lines, whereas the perforated media guide 240*a* is shown as a single dotted line. The space between the opposing solid media guides 240*b* forms a portion of the media path 4.

Figure 8:
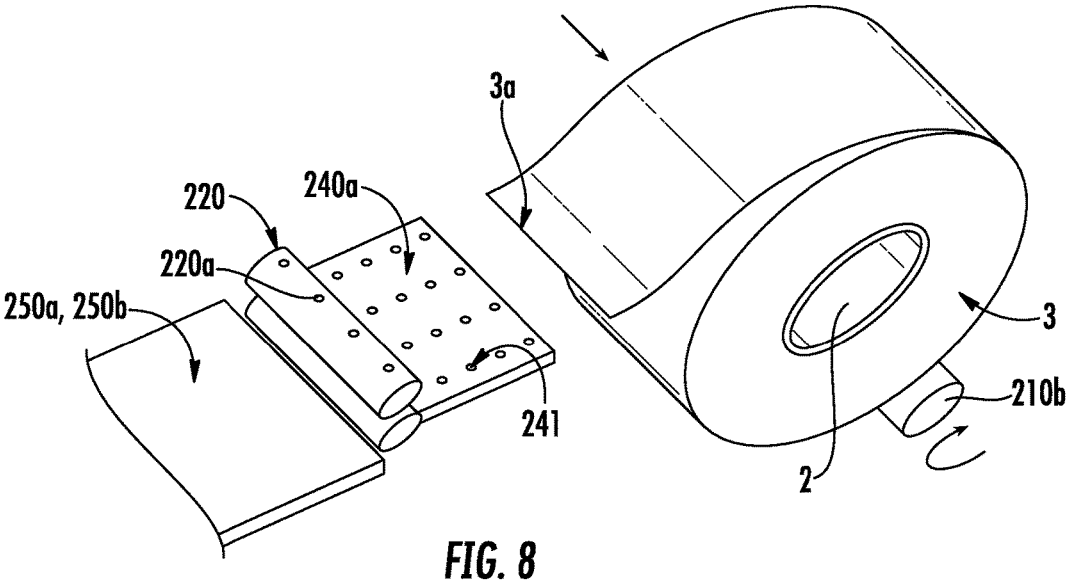
FIG. 8 is a perspective view of the perforated and solid media guides, and the vacuum roller.

As shown in the embodiment of FIG. 8, the perforated media guide 240*a* comprises a plurality of vacuum holes 241. The vacuum holes 241 are in operative communication with a vacuum source, such as the vacuum generator 221, so that a vacuum is created at each of the vacuum holes 241. In other embodiments, the vacuum is generated by a vacuum generator that is separate from the vacuum generator 221.

The pinch rollers 250*a*, 250*b* are positioned proximate to the second end of the media guide 240*a*. In an embodiment, both pinch rollers 250*a*, 250*b* are operatively connected to a motor (not shown) for operatively rotating the pinch rollers 250*a*,250*b* in the first and second directions. In another embodiment, one of the pinch rollers, for example pinch roller 250*a*, is operatively connected to a motor for operatively rotating the pinch roller 250*a*, and the other pinch roller is a free rolling roller. In a further embodiment, one of the pinch rollers, for example pinch roller 250*b*, is spring loaded, and is biased towards the other pinch roller.

The leading end detecting sensor 260 is positioned proximate to the pinch rollers 250*a*, 250*b* and between the pinch rollers 250*a*, 250*b* and the solid media guides 240*b* along the media path 4. The leading end detecting sensor 260 detects the leading edge 3*a* of the media 3 as the leading edge 3*a* nears the pinch rollers 250*a*,250*b*. In an embodiment, the leading end detecting sensor 260 is an infrared (IR) sensor, such as an IR-based photodiode sensor. In other embodiments, the leading end detecting sensor 260 is an imager-based sensor, or any other sensor known to the skilled artisan to detect a leading edge 3*a* of the media 3.

The printer 1 may also comprise a power source and a moveable cover (removed in the figures for purposes of illustration) for accessing the printing mechanism, an automatic media feeding system, media feed path, media hanger assembly, etc. contained within the housing. The printer 1 may further comprise a central processing unit (CPU) (not shown). As known in the art, the central processing unit (CPU) is the electronic circuitry within a computer that carries out the instructions of a computer program by performing the basic arithmetic, logical, control and input/output (I/O) operations specified by the methods described herein.

The printer 1 can also comprise a user interface (not shown) which can include, but is not limited to, a display for displaying information and function buttons that may be configured to perform various typical printing functions (e.g., cancel print job, advance print media, and the like) or be programmable for the execution of macros containing preset printing parameters for a particular type of print media. The display may include a touch screen keypad for entering data or the keypad may be separate. Additionally, the user interface may be operationally/communicatively coupled to the CPU (not shown) for controlling the operation of the printer, in addition to other functions. The user interface may be supplemented by or replaced by other forms of data entry or printer control such as a separate data entry and control module linked wirelessly or by a data cable operationally coupled to a computer, a router, or the like.

In the embodiment shown in FIG. 1, the printer 1 is shown without a media roll 3 positioned in the housing on the media hanger 2.

Figure 2:
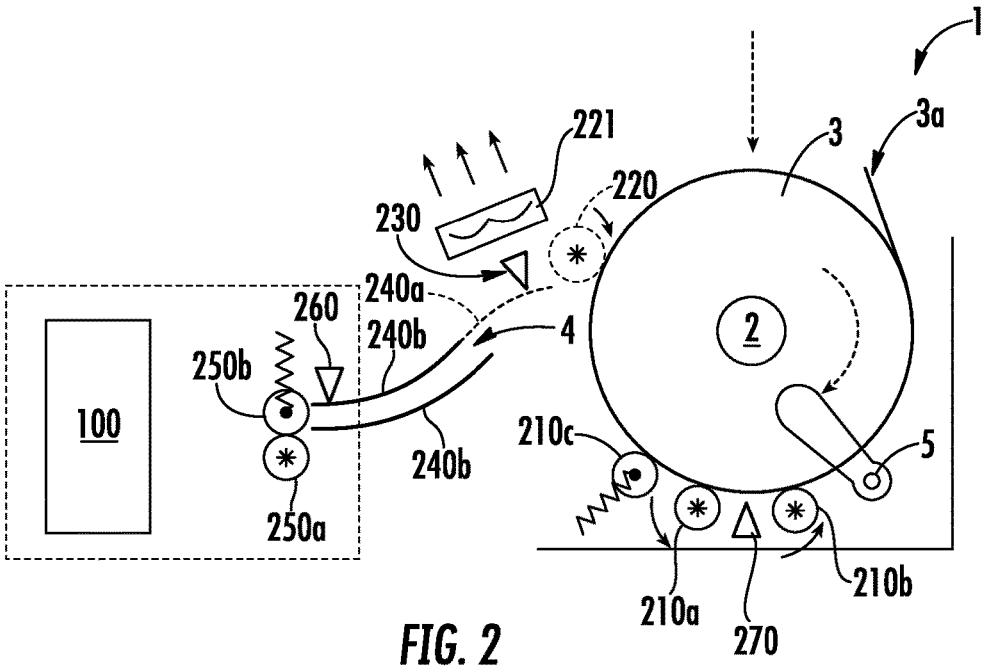
FIG. 2 is a schematic view of the printer after insertion of a roll of media.

In the embodiment shown in FIG. 2, the printer 1 has a media roll 3 positioned in the printer housing and placed on the media hanger 2. The spring loaded free roller 210*c* adjusts a position in the housing to contact the media roll 3 and biases the media roll 3 against the driving rollers 210*a*, 210*b*. The media center biasing mechanism 5 also adjust a position in the housing to contact the installed media roll 3 to hold the media 3 centered on the media hanger assembly 2. The media roll detecting sensor 270 detects the presence of the installed media roll 3, and the driving rollers 210*a*, 210*b* responsively rotate in the second direction, which is shown in FIG. 2 as being counterclockwise. However, the skilled artisan would understand that in other embodiments, the second direction may be clockwise. As the driving rollers 210*a*, 210*b* rotate in the second direction, the media roll 3 is rotated in the first direction. Additionally, the vacuum roller 220 also begins rotating in the first direction, and a vacuum is applied to both the vacuum roller 220 and the perforated media guide 240*a*.

Figure 3:
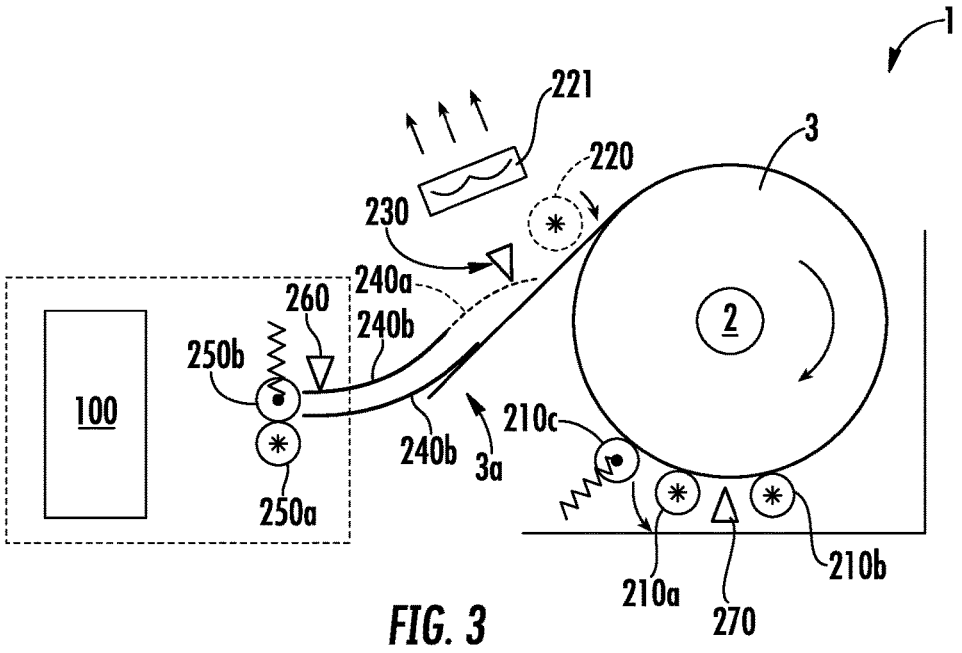
FIG. 3 is a schematic view of the printer where a leading edge of the media contacts a solid media guide.

In the embodiment of FIG. 3, as the media roll 3 rotates in the first direction, the leading edge 3*a* contacts the media guide 240*b*, with the media 3 contacting the vacuum roller 220.

Figure 4:
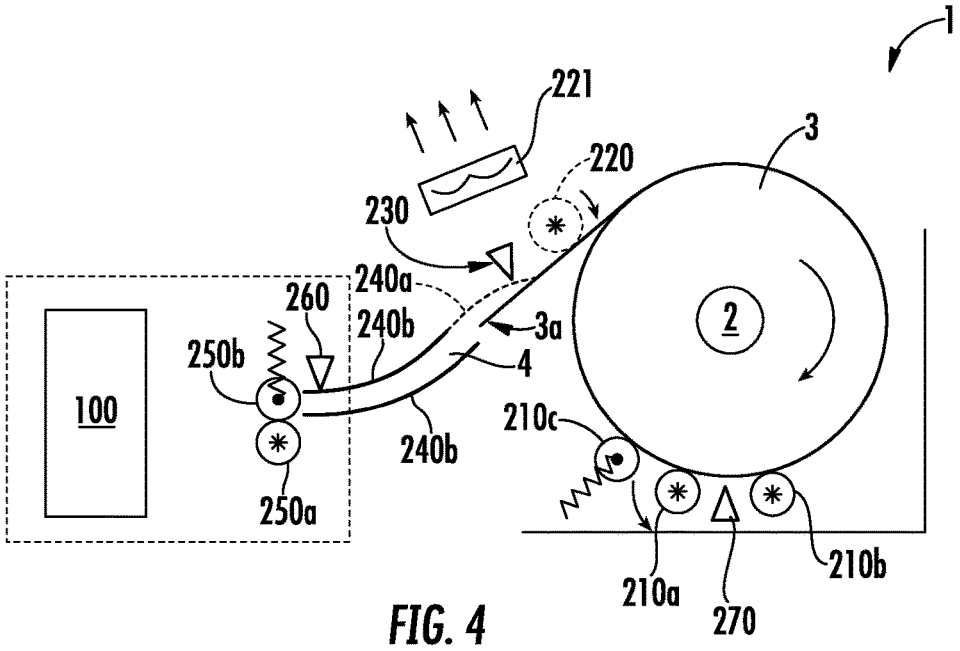
FIG. 4 is a schematic view of the printer where the leading edge of the media contacts a perforated media guide and vacuum roller.
Figure 5:
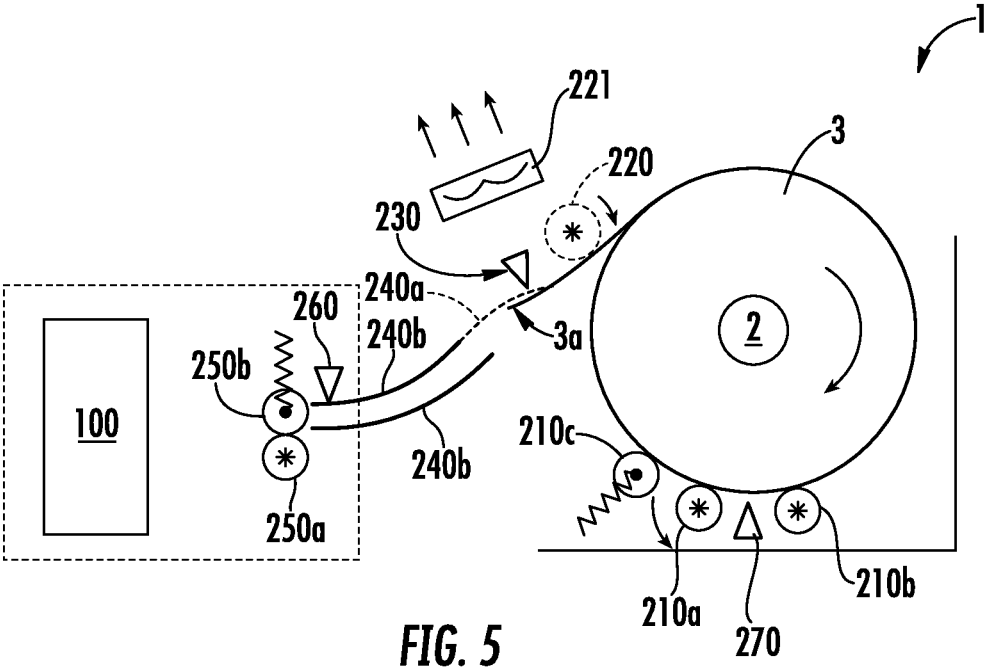
FIG. 5 is a schematic view of the printer where the leading edge of the media is detected by a media end detecting sensor.

In the embodiment of FIGS. 4 and 5, as the media roll 3 continues to rotate in the first direction, the leading edge 3*a* is vacuum drawn towards the vacuum roller 220, and ultimately towards the perforated media guide 240*a*. Upon contact of the leading edge 3*a* with the perforated media guide 240*a*, the media end detecting sensor 230 detects the leading edge 3*a*.

Figure 6:
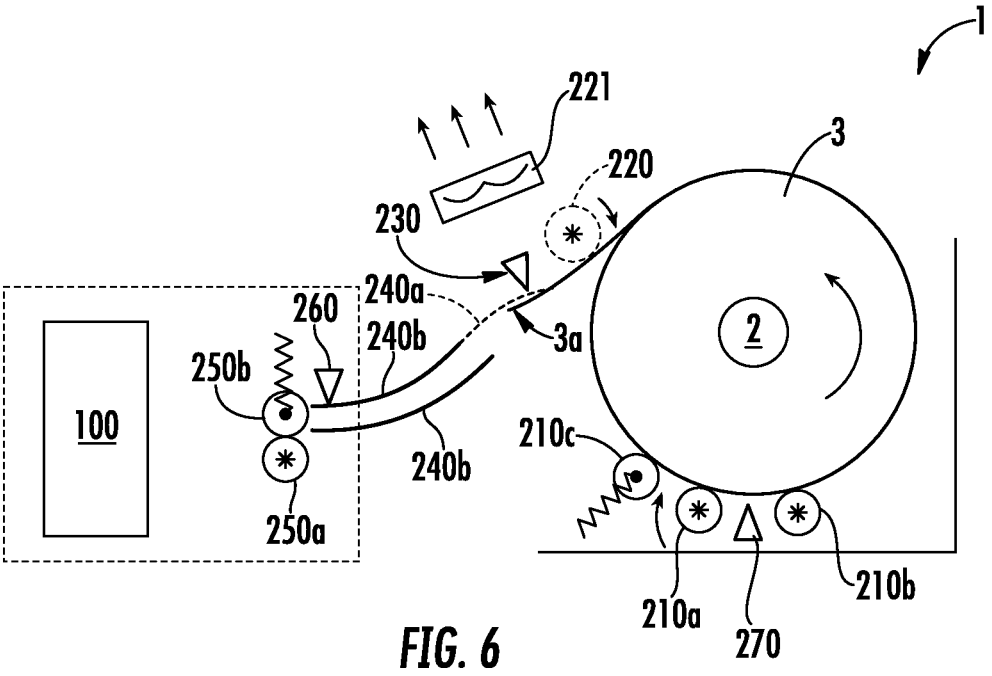
FIG. 6 is a schematic view of the printer where the leading edge of the media is advanced through the solid media drive along a media feed path.

As shown in the embodiment of FIG. 6, in response to the media end detecting sensor 230 detecting the leading edge 3*a*, the driving rollers 210*a*, 210*b* reverse rotation, and begin rotating in the first direction, which in turn, reverses the rotation of the media roll 3 to rotate in the second direction. By reversing the rotation of the media roll 3 to rotate in the second direction, the media roll 3 begins to unwind, pushing the lead edge 3*a* along the media feed path 4. The vacuum from perforated media guide 240*a* and the vacuum roller 220 holds the unwinding media 3 in the media feed path 4. The combination of the driving rollers 210*a*,210*b* and the vacuum roller 220 advances the leading edge 3*a* of the media 3 from the first end of the media guide towards the solid media guides 240*b* on the opposite second end of the media guide.

Figure 7:
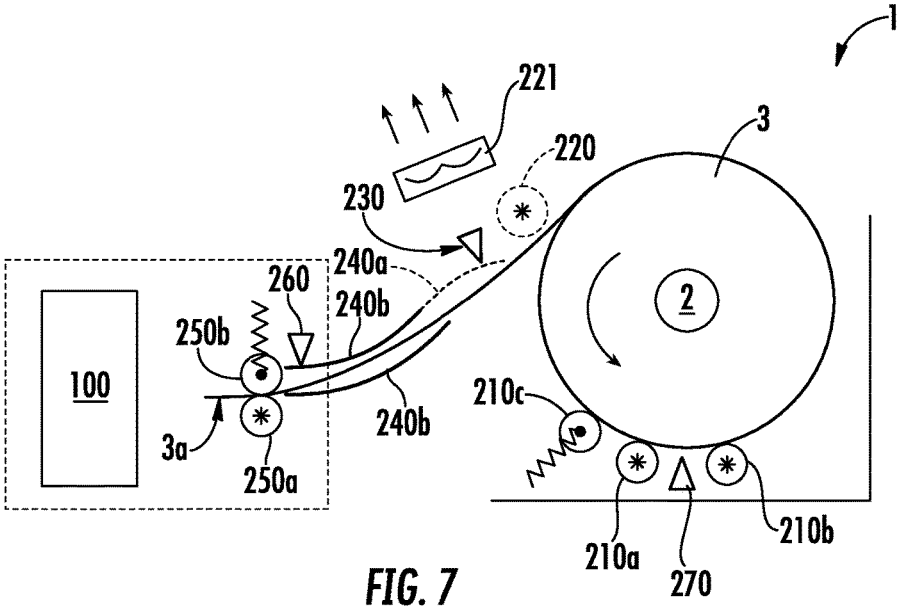
FIG. 7 is a schematic view of the printer where the media has been engaged by a pair of opposing pinch rollers.

In the embodiment of FIG. 7, the leading edge 3*a* of the media 3 has advanced along the media feed path 4, and has engaged the pinch rollers 250*a*,250*b*. The pinch rollers 250*a*,250*b* will then advance the leading edge 3*a* into the printing mechanism 100. Prior to engaging the pinch rollers 250*a*,250*b*, the leading end detecting sensor 260 detects the presence of the leading edge 3*a* prior to the leading edge 3*a* contacting the pinch rollers 250*a*,250*b*. In an embodiment, responsive to detecting the leading edge 3*a*, the pinch rollers 250*a*,250*b* begin rotating prior to arrival of the leading edge 3*a*.

In an embodiment, once the pinch rollers 250*a*,250*b* have engaged the media 3, the vacuum source is removed from the perforated media guide 240*a* and the vacuum roller 220. Optionally, the vacuum roller 220 and the driving rollers 210*a*, 210*b* are also disengaged from the motors, and allowed to free spin. Thus, the pinch rollers 250*a*, 250*b* can control media 3 advancement through the printing mechanism 100.

Figure 9:
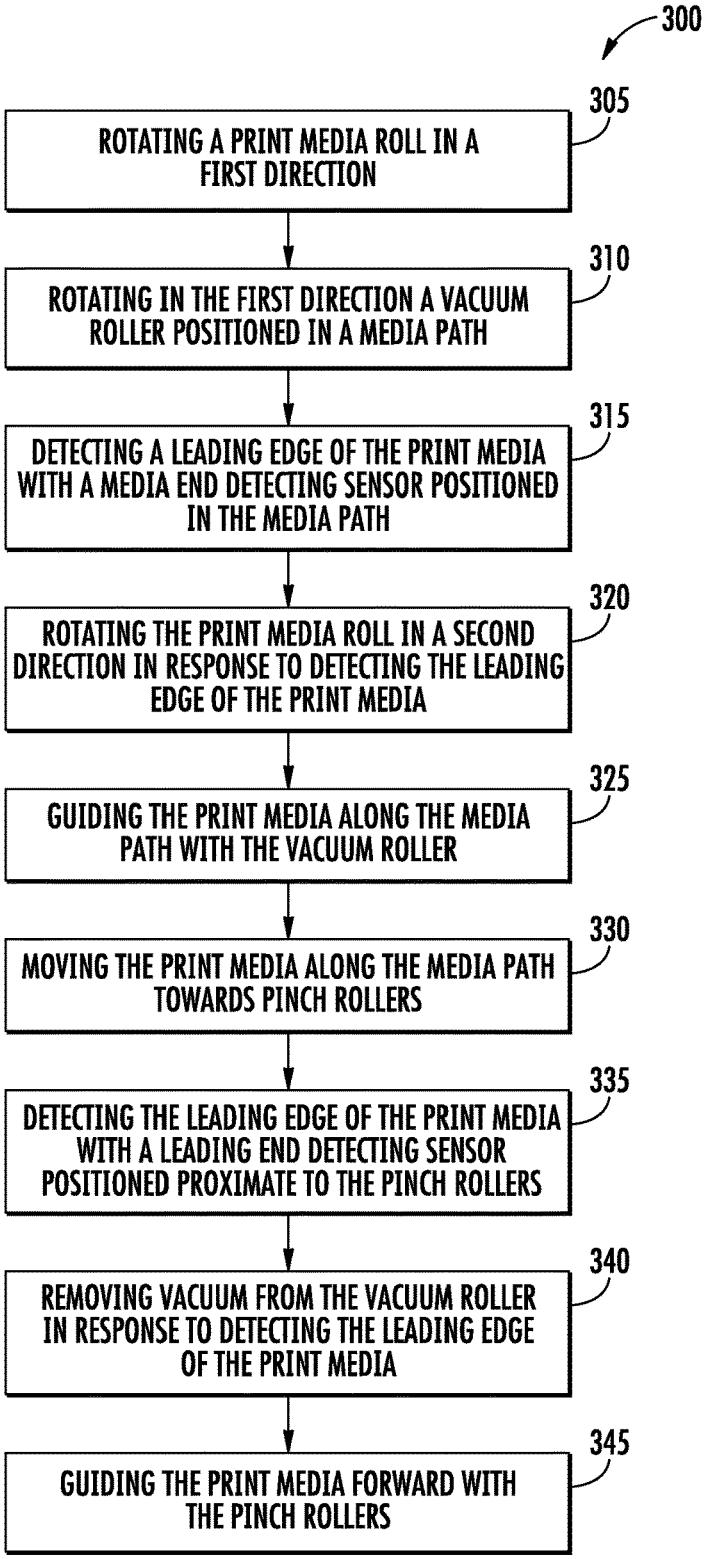
FIG. 9 is a block diagram of a method for loading the media in the printer.

FIG. 9 describes a method 300 for loading print media 3 in the printer 1. After loading the print media roll 3 into the printer 1, the print media roll 3 is rotated in a first direction at block 305. As the print media roll 3 is rotated in the first direction, the vacuum roller 220 is rotated in the first direction at block 310. At block 315, the leading edge 3*a* of the print media 3 is detected by the media end detecting sensor 230. In response to detecting the leading edge 3*a* of the print media 3, the print media roll 3 is rotated in the second direction at block 320. At block 325, the print media 3 is guided along the media path 4 with the vacuum roller 220. At block 330 the print media 3 is guided along a media path 4 by the media guides 240*a*,240*b*,240*c* positioned proximate to the vacuum roller 220. The print media 3 is moved along the media path 4 towards pinch rollers 250*a*, 250*b* at block 330. The leading edge 3*a* of the print media 3 is detected with a leading end detecting sensor 260 positioned proximate to the pinch rollers 250*a*,250*b* at block 335. At block 340, the vacuum is removed from the vacuum roller 220 in response to detecting the leading edge 3*a* of the print media 3. At block 345, the print media 3 is guided forward towards the printing mechanism 100 by the pinch rollers 250*a*,250*b*.

To supplement the present disclosure, this application incorporates entirely by reference the following commonly assigned patents, patent application publications, and patent applications:

U.S. Pat. Nos. 6,832,725; 7,128,266;
U.S. Pat. Nos. 7,159,783; 7,413,127;
U.S. Pat. Nos. 7,726,575; 8,294,969;
U.S. Pat. Nos. 8,317,105; 8,322,622;
U.S. Pat. Nos. 8,366,005; 8,371,507;
U.S. Pat. Nos. 8,376,233; 8,381,979;

U.S. Pat. Nos. 8,390,909; 8,408,464;
U.S. Pat. Nos. 8,408,468; 8,408,469;
U.S. Pat. Nos. 8,424,768; 8,448,863;
U.S. Pat. Nos. 8,457,013; 8,459,557;
U.S. Pat. Nos. 8,469,272; 8,474,712;
U.S. Pat. Nos. 8,479,992; 8,490,877;
U.S. Pat. Nos. 8,517,271; 8,523,076;
U.S. Pat. Nos. 8,528,818; 8,544,737;
U.S. Pat. Nos. 8,548,242; 8,548,420;
U.S. Pat. Nos. 8,550,335; 8,550,354;
U.S. Pat. Nos. 8,550,357; 8,556,174;
U.S. Pat. Nos. 8,556,176; 8,556,177;
U.S. Pat. Nos. 8,559,767; 8,599,957;
U.S. Pat. Nos. 8,561,895; 8,561,903;
U.S. Pat. Nos. 8,561,905; 8,565,107;
U.S. Pat. Nos. 8,571,307; 8,579,200;
U.S. Pat. Nos. 8,583,924; 8,584,945;
U.S. Pat. Nos. 8,587,595; 8,587,697;
U.S. Pat. Nos. 8,588,869; 8,590,789;
U.S. Pat. Nos. 8,596,539; 8,596,542;
U.S. Pat. Nos. 8,596,543; 8,599,271;
U.S. Pat. Nos. 8,599,957; 8,600,158;
U.S. Pat. Nos. 8,600,167; 8,602,309;
U.S. Pat. Nos. 8,608,053; 8,608,071;
U.S. Pat. Nos. 8,611,309; 8,615,487;
U.S. Pat. Nos. 8,616,454; 8,621,123;
U.S. Pat. Nos. 8,622,303; 8,628,013;
U.S. Pat. Nos. 8,628,015; 8,628,016;
U.S. Pat. Nos. 8,629,926; 8,630,491;
U.S. Pat. Nos. 8,635,309; 8,636,200;
U.S. Pat. Nos. 8,636,212; 8,636,215;
U.S. Pat. Nos. 8,636,224; 8,638,806;
U.S. Pat. Nos. 8,640,958; 8,640,960;
U.S. Pat. Nos. 8,643,717; 8,646,692;
U.S. Pat. Nos. 8,646,694; 8,657,200;
U.S. Pat. Nos. 8,659,397; 8,668,149;
U.S. Pat. Nos. 8,678,285; 8,678,286;
U.S. Pat. Nos. 8,682,077; 8,687,282;
U.S. Pat. Nos. 8,692,927; 8,695,880;
U.S. Pat. Nos. 8,698,949; 8,717,494;
U.S. Pat. Nos. 8,717,494; 8,720,783;
U.S. Pat. Nos. 8,723,804; 8,723,904;
U.S. Pat. Nos. 8,727,223; 8,740,082;
U.S. Pat. Nos. 8,740,085; 8,746,563;
U.S. Pat. Nos. 8,750,445; 8,752,766;
U.S. Pat. Nos. 8,756,059; 8,757,495;
U.S. Pat. Nos. 8,760,563; 8,763,909;
U.S. Pat. Nos. 8,777,108; 8,777,109;
U.S. Pat. Nos. 8,779,898; 8,781,520;
U.S. Pat. Nos. 8,783,573; 8,789,757;
U.S. Pat. Nos. 8,789,758; 8,789,759;
U.S. Pat. Nos. 8,794,520; 8,794,522;
U.S. Pat. Nos. 8,794,525; 8,794,526;
U.S. Pat. Nos. 8,798,367; 8,807,431;
U.S. Pat. Nos. 8,807,432; 8,820,630;
U.S. Pat. Nos. 8,822,848; 8,824,692;
U.S. Pat. Nos. 8,824,696; 8,842,849;
U.S. Pat. Nos. 8,844,822; 8,844,823;
U.S. Pat. Nos. 8,849,019; 8,851,383;
U.S. Pat. Nos. 8,854,633; 8,866,963;
U.S. Pat. Nos. 8,868,421; 8,868,519;
U.S. Pat. Nos. 8,868,802; 8,868,803;
U.S. Pat. Nos. 8,870,074; 8,879,639;
U.S. Pat. Nos. 8,880,426; 8,881,983;
U.S. Pat. Nos. 8,881,987; 8,903,172;
U.S. Pat. Nos. 8,908,995; 8,910,870;
U.S. Pat. Nos. 8,910,875; 8,914,290;
U.S. Pat. Nos. 8,914,788; 8,915,439;
U.S. Pat. Nos. 8,915,444; 8,916,789;
U.S. Pat. Nos. 8,918,250; 8,918,564;
U.S. Pat. Nos. 8,925,818; 8,939,374;
U.S. Pat. Nos. 8,942,480; 8,944,313;
U.S. Pat. Nos. 8,944,327; 8,944,332;
U.S. Pat. Nos. 8,950,678; 8,967,468;
U.S. Pat. Nos. 8,971,346; 8,976,030;
U.S. Pat. Nos. 8,976,368; 8,978,981;
U.S. Pat. Nos. 8,978,983; 8,978,984;
U.S. Pat. Nos. 8,985,456; 8,985,457;
U.S. Pat. Nos. 8,985,459; 8,985,461;
U.S. Pat. Nos. 8,988,578; 8,988,590;
U.S. Pat. Nos. 8,991,704; 8,996,194;
U.S. Pat. Nos. 8,996,384; 9,002,641;
U.S. Pat. Nos. 9,007,368; 9,010,641;
U.S. Pat. Nos. 9,015,513; 9,016,576;
U.S. Pat. Nos. 9,022,288; 9,030,964;
U.S. Pat. Nos. 9,033,240; 9,033,242;
U.S. Pat. Nos. 9,036,054; 9,037,344;
U.S. Pat. Nos. 9,038,911; 9,038,915;
U.S. Pat. Nos. 9,047,098; 9,047,359;
U.S. Pat. Nos. 9,047,420; 9,047,525;
U.S. Pat. Nos. 9,047,531; 9,053,055;
U.S. Pat. Nos. 9,053,378; 9,053,380;
U.S. Pat. Nos. 9,058,526; 9,064,165;
U.S. Pat. Nos. 9,064,165; 9,064,167;
U.S. Pat. Nos. 9,064,168; 9,064,254;
U.S. Pat. Nos. 9,066,032; 9,070,032;
U.S. Pat. Nos. 9,076,459; 9,079,423;
U.S. Pat. Nos. 9,080,856; 9,082,023;
U.S. Pat. Nos. 9,082,031; 9,084,032;
U.S. Pat. Nos. 9,087,250; 9,092,681;
U.S. Pat. Nos. 9,092,682; 9,092,683;
U.S. Pat. Nos. 9,093,141; 9,098,763;
U.S. Pat. Nos. 9,104,929; 9,104,934;
U.S. Pat. Nos. 9,107,484; 9,111,159;
U.S. Pat. Nos. 9,111,166; 9,135,483;
U.S. Pat. Nos. 9,137,009; 9,141,839;
U.S. Pat. Nos. 9,147,096; 9,148,474;
U.S. Pat. Nos. 9,158,000; 9,158,340;
U.S. Pat. Nos. 9,158,953; 9,159,059;
U.S. Pat. Nos. 9,165,174; 9,171,543;
U.S. Pat. Nos. 9,183,425; 9,189,669;
U.S. Pat. Nos. 9,195,844; 9,202,458;
U.S. Pat. Nos. 9,208,366; 9,208,367;
U.S. Pat. Nos. 9,219,836; 9,224,024;
U.S. Pat. Nos. 9,224,027; 9,230,140;
U.S. Pat. Nos. 9,235,553; 9,239,950;
U.S. Pat. Nos. 9,245,492; 9,248,640;
U.S. Pat. Nos. 9,250,652; 9,250,712;
U.S. Pat. Nos. 9,251,411; 9,258,033;
U.S. Pat. Nos. 9,262,633; 9,262,660;
U.S. Pat. Nos. 9,262,662; 9,269,036;
U.S. Pat. Nos. 9,270,782; 9,274,812;
U.S. Pat. Nos. 9,275,388; 9,277,668;
U.S. Pat. Nos. 9,280,693; 9,286,496;
U.S. Pat. Nos. 9,298,964; 9,301,427;
U.S. Pat. Nos. 9,313,377; 9,317,037;
U.S. Pat. Nos. 9,319,548; 9,342,723;
U.S. Pat. Nos. 9,361,882; 9,365,381;
U.S. Pat. Nos. 9,373,018; 9,375,945;
U.S. Pat. Nos. 9,378,403; 9,383,848;
U.S. Pat. Nos. 9,384,374; 9,390,304;
U.S. Pat. Nos. 9,390,596; 9,411,386;
U.S. Pat. Nos. 9,412,242; 9,418,269;
U.S. Pat. Nos. 9,418,270; 9,465,967;

U.S. Pat. Nos. 9,423,318; 9,424,454;
U.S. Pat. Nos. 9,436,860; 9,443,123;
U.S. Pat. Nos. 9,443,222; 9,454,689;
U.S. Pat. Nos. 9,464,885; 9,465,967;
U.S. Pat. Nos. 9,478,983; 9,481,186;
U.S. Pat. Nos. 9,487,113; 9,488,986;
U.S. Pat. Nos. 9,489,782; 9,490,540;
U.S. Pat. Nos. 9,491,729; 9,497,092;
U.S. Pat. Nos. 9,507,974; 9,519,814;
U.S. Pat. Nos. 9,521,331; 9,530,038;
U.S. Pat. Nos. 9,572,901; 9,558,386;
U.S. Pat. Nos. 9,606,581; 9,646,189;
U.S. Pat. Nos. 9,646,191; 9,652,648;
U.S. Pat. Nos. 9,652,653; 9,656,487;
U.S. Pat. Nos. 9,659,198; 9,680,282;
U.S. Pat. Nos. 9,697,401; 9,701,140;
U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;

U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;

U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

What is claimed is:

1. A method for loading print media in a printer, the method comprising:

rotating a print media roll having a leading edge in a first direction;

rotating in the first direction a vacuum roller positioned prior to a media guide in a media path;

detecting the leading edge of the print media with a media end detecting sensor positioned in the media path prior to the leading edge being received by the media guide;

rotating the print media roll in a second direction in response to detecting the leading edge of the print media prior to the leading edge being received by the media guide; and guiding the print media along the media path with the vacuum roller.

2. The method of claim 1, wherein the print media roll is rotated by a driving roller configured to rotate in a first direction and a second direction.

3. The method of claim 1, wherein the first direction is opposite of the second direction.

4. The method of claim 1, wherein the first direction is clockwise.

5. The method of claim 1, wherein the second direction is counterclockwise.

6. The method of claim 1, wherein the vacuum roller is perforated and operatively connected to a vacuum source.

7. The method of claim 1, wherein the media end detecting sensor is positioned proximate to the vacuum roller and the print media, and prior to the media guide.

8. The method of claim 1, wherein the print media is guided along a media path by the media guide positioned proximate to the vacuum roller.

9. The method of claim 1, wherein at least a portion of the media guide is perforated, wherein another portion of the media guide corresponds to solid media guides.

10. The method of claim 1, comprising:

moving the print media along the media path towards pinch rollers;

detecting the leading edge of the print media with a leading end detecting sensor positioned proximate to the pinch rollers;

removing vacuum from the vacuum roller in response to detecting the leading edge of the print media; and guiding the print media forward with the pinch rollers.

11. A media feeding system, comprising:

a driver configured to rotate a media roll in a first direction;

a vacuum roller positioned before a media guide in a media feed path and configured to rotate in the first direction; and a media end detecting sensor positioned before the media guide and after the vacuum roller in the media feed path, the media end detecting sensor being configured to detect a leading edge of the media;

wherein the driver rotates the media roll in a second direction opposite the first direction in response to the sensor detecting the leading end of the media prior to being received by the media guide.

12. The media feeding system of claim 11, wherein the driver comprises a driving roller configured to rotate in a first direction and a second direction.

13. The media feeding system of claim 11, wherein the vacuum roller is perforated and operatively connected to a vacuum source.

14. The media feeding system of claim 11, wherein the media end detecting sensor is positioned proximate to the vacuum roller and the print media, and before the media guide.

15. The media feeding system of claim 11, comprising the media guide positioned proximate to the vacuum roller along a length of a media path.

16. The media feeding system of claim 15, wherein a first portion of the media guide is perforated and a second portion of the media guide is a solid media guide, wherein the first portion of the media guide comprises a plurality of vacuum holes which are in operative communication with a vacuum source.

17. The media feeding system of claim 11, comprising:

pinch rollers positioned along the media feed path; and a leading end detecting sensor located proximate to the pinch rollers, the sensor configured to detect the leading edge of the media;

wherein vacuum is removed from the vacuum roller and the media is guided forward by the pinch rollers in response to the leading end detecting sensor detecting the leading end of the media.

18. A printer, comprising:

a housing;

a printing mechanism positioned in the housing; and a media feeding mechanism positioned in the housing, comprising:

a vacuum roller positioned in a media path prior to a media guide, the vacuum roller being configured to rotate in a first direction and push media along a media path, a media end detecting sensor positioned in the media path prior to the media guide, a driver configured to rotate a media roll in a second direction in response to the media end detecting sensor detecting a leading end of the media prior to being received by the media guide, and a first portion of the media guide configured to guide media pushed by the vacuum roller along the media path.

19. The printer of claim 18, wherein first portion of the media guide is perforated media guide, wherein a second portion of the media guide is a solid media guide.

20. The printer of claim 18, comprising:

pinch rollers positioned along the media path; and a leading end detecting sensor positioned proximate to the pinch rollers, the leading end detecting sensor being configured to detect the leading end of the media;

wherein vacuum is removed from the vacuum roller in response to detecting the leading edge of the media and the media is guided forward by the pinch rollers.

* * * * *